US005567276A

United States Patent [19]

Boehm et al.

[11] Patent Number: 5,567,276

[45] Date of Patent: Oct. 22, 1996

[54] PAPER OF VALUE AND A METHOD OF PRODUCING IT

[75] Inventors: Michael Boehm, Heimstetten; Wittich Kaule, Emmering, both of Germany

[73] Assignee: GAO Gesellschaft fuer Automation und Organisation mbH, Munich, Germany

[21] Appl. No.: 278,114

[22] Filed: Jul. 20, 1994

Related U.S. Application Data

[63] Continuation of Ser. No. 792,256, Nov. 15, 1991, abandoned.

[30] Foreign Application Priority Data

Nov. 16, 1990 [DE] Germany ..... 40 36 637.5

[51] Int. Cl.[6] ..... D21D 3/00; D21H 5/10

[52] U.S. Cl. ..... 162/103; 162/108; 162/140

[58] Field of Search ..... 162/103, 108, 162/140

[56] References Cited

U.S. PATENT DOCUMENTS

| | | | |
|---|---|---|---|
| 2,126,922 | 8/1938 | Robinson | 92/10 |
| 4,420,515 | 12/1983 | Amon et al. | 428/29 |
| 4,437,935 | 3/1984 | Crane, Jr. | 162/103 |
| 4,534,398 | 8/1985 | Crane | 162/103 |
| 4,547,002 | 10/1985 | Colgate, Jr. | 283/91 |
| 5,020,581 | 6/1991 | Gutierrez | 162/103 |

FOREIGN PATENT DOCUMENTS

| | | | |
|---|---|---|---|
| 0229645 | 7/1987 | European Pat. Off. . | |
| 0338378 | 10/1989 | European Pat. Off. . | |
| 0400902 | 12/1990 | European Pat. Off. . | |
| 63-182497 | 7/1988 | Japan | 162/140 |

OTHER PUBLICATIONS

Casey, "*Pulp and Paper*", Chemistry & Chemical Technology, 3rd Ed., vol. III.

*Primary Examiner*—Peter Chin
*Attorney, Agent, or Firm*—Foley & Lardner

[57] ABSTRACT

The present invention relates to a paper of value having an embedded security element, preferably an optically variable element in the form of hologram, diffraction or interference structures applied to the paper surface, and to a method for producing such a paper of value. The paper of value is characterized by the fact that the optically variable element is embedded in the paper of value with the paper surface forming a plane that is even with the surface of the optically variable element.

17 Claims, 5 Drawing Sheets

PAPER OF VALUE AND A METHOD OF PRODUCING IT

This application is a continuation, of application Ser. No. 07/792,256, filed Nov. 15, 1991.

BACKGROUND OF THE INVENTION

The present invention relates to a paper of value (securities) having an embedded security element, preferably an optically variable element in the form of hologram, diffraction or interference structures applied to the paper surface. The invention also relates to a method for producing such a paper of value.

To be protected against imitation by means of color copiers, papers of value or securities are increasingly provided with optically variable security elements, in particular holograms. This protection against forgery is based on the color copier's insufficient ability to reproduce the optical properties of the elements.

Various methods are known for applying the optically variable elements to papers of value. They can usually be divided into three categories, namely, gluing, transfer printing and embossing.

By the gluing method, adhesive labels that are initially prepunched on silicone paper, for example, are transferred to the paper substrate. The adhesive labels have a layer structure composed of at least a contact adhesive layer, a self-supporting film of an optically active layer (for example, with a diffraction grid), and a protective layer located thereabove. The thickness of an adhesive label is typically in the range of 50 micrometers, the main part of the thickness being due to the carrier film.

In transfer printing, also known as "hot stamping," the optically variable element is prefabricated on a transfer band and transferred to the substrate in a subsequent working step. The structure transferred to the paper typically has a thickness in the range of a few micrometers. In the case of holograms, the customary layer structure of the element comprises a heat-sealing layer, a layer of lacquer with an embossing, an aluminized layer and a transparent covering protective layer. This layer structure is initially located on the transfer foil, being affixed to the foil by a release layer (e.g. a wax layer). One transfers the band by placing it with the heat-sealing layer on the substrate and activating the heat-sealing layer by pressing with a heated die, so that the element bonds with the substrate. Simultaneously, the separation layer melts, thereby detaching the hologram from the transfer band. The transfer principle is the most frequently applied method today and is in particular also used customarily for applying holograms to plastic credit cards.

The embossing method is mainly suitable for diffraction elements, such as holograms and optical grids. A layer of hardenable lacquer is applied to a substrate that is preferably provided with an extremely thin and reflective metal surface. A press die is then used to emboss the diffraction relief structure into the layer of lacquer. After the lacquer has hardened, the structure is covered with a protective lacquer. The finished element has a layer structure comprising the successive layers of lacquer with the metal layer and relief structure and the layer of protective lacquer.

Each of the known methods and the resulting products has its own special advantages and disadvantages. For example, adhesive labels are technically easy to produce and can be transferred to the intended substrates without any trouble. An extreme disadvantage of adhesive labels for application to securities, however, is that the entire elements can be detached from the substrate and transferred to forged products. For this reason, transfer and embossed elements are preferred for securities applications.

Transfer and embossed elements largely meet the requirements in terms of protection from forgery for securities, but these elements involve a number of production engineering problems in connection with papers of value.

It must be taken into consideration that papers of value customarily have a high-security printed pattern; these patterns are applied in most cases by steel intaglio printing. Steel intaglio printing and related methods require a relatively high surface roughness of the substrate for the inks to bond well with the substrate. However, rough surfaces are extremely unsuitable for the application of optically variable elements, which have little stability. The quality of sensitive hologram structures is affected very adversely by rough surface structures.

It must be heeded that the paper of value is subjected to a very high pressure load in its whole surface during steel intaglio printing. This customarily reduces the optical effect of any optical elements applied prior to printing; the elements can even be damaged or fully destroyed by the proper roughness pressed through from the paper base.

When producing papers of value having optically variable elements, one therefore first provides the paper of value with the printed pattern and then applies the hologram in one of the following method steps, or one divides the application of the elements into single steps, performing the measures not endangered by steel intaglio printing before the printing and the others only after it. One thereby accepted the disadvantages up to now that this direct coupling with the printing process made it impossible to prefabricate unprinted papers of value with optically variable elements in a job-neutral way (stockpile production), on the one hand, and that the application of the optically variable elements requires suitable machines (transfer machines, etc.) for each printing line, on the other hand. The special machines required for each printing line not only increase the cost and the space requirements of the machinery, but also cause a bottleneck at the end of each printing line due to their different production capacity, which can only be compensated by additional machinery.

EP-A 0 338 378 discloses such a system for producing paper products that have both a printed pattern and an optical diffraction element. In a continuous process the paper is first printed in known printing units. Then, as in the described embossing method, a radiation hardenable lacquer is applied and provided with a diffraction structure in one operation. In subsequent operations the diffraction structure is vacuum coated with a reflective metal layer and provided with a protective lacquer.

In other known systems, the operation of applying the hologram is divided into two steps. Following papermaking, the lacquer is applied to the paper surface in a first step. After the paper is printed, the optical grid is embossed in the next step.

U.S. Pat. No. 4,420,515 describes a variant of this bipartite method. A metal layer with an adhesive layer thereabove is first applied to a plastic transfer band having a prepared surface. These two layers form the substructure of the future security element. In the first step the two layers are laminated onto the substrate, whereby the substructure of the element takes on the surface quality of the transfer band under the action of heat and pressure in the laminating operation. In the second step, a printed pattern and an optically acting relief structure are applied to the substrate.

The forced order of printing and applying the optically effective layers or optically effective structures leads, as already mentioned, to a number of serious disadvantages.

A further disadvantage of the known methods is the difficulty of integrating them into the organizational sequence of security printing plants. For security reasons it is virtually indispensable in paper of value manufacture for the printing process, in particular the printing of the serial number, to be the last processing operation before delivery of the papers of value. In security printing plants it is therefore an established custom to prefabricate paper with the corresponding security features, such as watermarks, safeguarding thread and any optical elements, and then to print it. This manufacturing sequence is likewise not possible with the known methods.

SUMMARY OF THE INVENTION

The present invention has as its objects to provide a paper of value having a security element, in particular an optically variable element, and a method for producing it, which make it possible to print the paper of value subsequently, in particular by steel intaglio printing, without damaging the optically variable element. The application of the optically variable elements to the paper of value is to be integrated into the papermaking process in such a way that relatively fast-working reel machines can be used. Finally, the application of the optically variable elements is to be integrated into production sequences in such a way that the currently existing machines need be changed as little as possible.

In accomplishing these objects, there has been provided in accordance with one aspect of the present invention a paper of value, comprising a layer of paper having a generally planar surface and having a security element embedded in the layer of paper, wherein the security element is embedded in a paper of value in a manner such that the surface of the security element forms an essentially uninterrupted, smooth surface with the generally planar surface of the paper layer. Preferably, the security element is an optically variable element in the form of a carrier film bearing a hologram, diffraction or interference structure.

In accordance with another aspect of the invention, there has been provided a method for producing a paper of value having bonded to its surface an optically variable element in the form of a carrier film bearing a hologram, diffraction or interference structure, comprising the steps of a) providing the carrier film in the form of an endless strip; b) feeding the strip to a wet paper web during production of the paper directly before or directly after the paper web is taken from the vat of a paper machine; c) calendering the paper web with calender rollers in the paper machine together with the carrier film lying on or near the surface of the paper web; and d) drying the paper web.

According to yet another aspect of the present invention, there has been provided a method for producing a paper of value having bonded to its surface an optically variable element in the form of a carrier film bearing a hologram, diffraction or interference structure comprising the steps of: a) providing the carrier film in the form of an endless strip coated with an adhesive; feeding the strip within the paper machine at the latest, to a wet paper web to lay down the strip within the paper materials so that the thickness of the strip plus the paper corresponds approximately to the paper thickness in the adjacent areas; c) calendering the product of step b) in the paper machine; and d) drying the paper web.

Further objects, features and advantages of the present invention will become apparent from the detailed description of preferred embodiments that follows, when considered together with the appended figures of drawing.

BRIEF DESCRIPTION OF THE DRAWINGS

In the following, preferred embodiments of the invention will be described by way of example with reference to the enclosed drawings, in which.

DETAILED DESCRIPTION OF PREFERRED EMBODIMENTS

Figure 1:
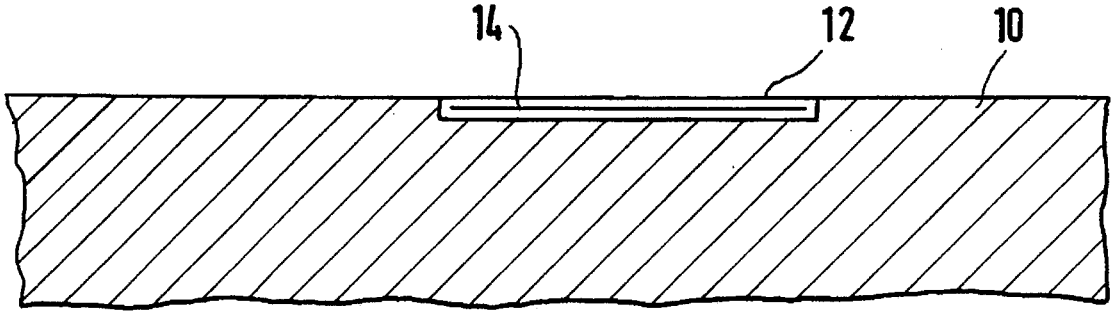
FIG. 1 shows a cross section through a paper of value having an embedded hologram element.

The invention is based on the finding that optically variable elements and paper are two materials with extremely different properties, and that different demands are also made on the two materials in accordance with the intended function. Paper, in particular paper of value, should have, among other properties, a certain "touch"; it must also be able to take on and bind inks. These properties are achieved by selecting special types of paper, preferably rag paper, and by setting a predetermined surface roughness and structure. Optically variable elements, by contrast, should have optical properties that are as effective as possible. For this purpose, the laws of physics primarily demand surface structures characterized by very high smoothness and flatness.

When optical elements are applied to paper there is thus always a danger of the surface roughness of the paper being embossed into the sometimes very sensitive layers of the planar element and damaging, impairing or even destroying them. It is therefore generally necessary to strike a balance between the different surface qualities to prevent such an impairment.

In contrast to the previous procedure, by which the optically variable elements were always embossed, glued or transferred to the paper of value only after the production proper, the invention involves connecting the optically variable element with the paper of value already during the papermaking process, more precisely when the paper of value is still relatively moist, soft and not yet couched or calendered. Unlike the dried and hardened state of the paper, this phase makes it possible to press a pressure-sensitive optically variable element into the paper materials without causing any damage. The high water content in this phase of production has a pressure-compensating effect and permits the carrier film to be embedded uniformly into the paper materials.

The surface roughness of the paper does not emboss the carrier film, as when the optically variable elements are applied subsequently. Instead, the still flexible paper fibers adapt to the smooth lower surface of the carrier films, which are supported on their other side by the smooth surfaces of the calendar rollers.

This results in an embedding of the optically variable element in the paper substance whereby the paper surface is flush with the surface of the optically variable element. It is readily possible to print subsequently, even in the areas of the optically variable element, since the high pressures that occur do not lead to an excessive load on the optically variable element embedded in the surface of the paper of value.

It is particularly advantageous for carrying out the inventive method if the optically variable elements exist in the form of a strip, like known safeguarding threads. The strip may have width of, for example, from a few millimeters to a few centimeters. Unlike such safeguarding threads, the carrier films are placed with the optically active structure on the formed paper layer after sheet forming is concluded or almost concluded. The film is thus either brought to the forming vat outside the pulp after the paper layer has been completely formed, i.e. it is placed on the paper fiber layer after the forming vat has been left, or the film is brought to the forming vat by means of nozzles in the pulp after e.g. 90% of the final paper thickness exists, so that the thickness of the film strip plus the paper corresponds approximately to the paper thickness in the adjacent areas. The subsequent method steps, such as calendering, gluing, drying, etc., correspond to the customary procedure. They firmly anchor the carrier film in the paper of value. The paper-side layer of the carrier film is preferably provided with an adhesive layer which hardens when the paper dries. Depending on the particular embodiment, i.e. film width, rigidity, time of application, etc., the artisan will select the particular suitable adhesive from the range of commercially available adhesives. Particularly suitable adhesives appear to be both contact adhesives and water-soluble adhesives or hot-melt adhesives. It is also possible to support the hardening of the adhesive by appropriate UV or infrared radiation.

If no endless film strip is to be used, individual optically variable elements in the form of adhesive labels can also be provided. These adhesive labels are preferably affixed to an endless transfer band that is removed later, i.e. after the labels are anchored in the paper materials.

Since the hologram application can be performed in the reel stage of the paper, high processing speeds are possible.

The independence of the printing process and the hologram application results in the further advantage that the production sequence customary in security printing plants can be maintained. Thus, the paper can be prefabricated, and also stored if necessary, with all its security elements, such as watermark, safeguarding thread, optically variable element, etc. The printing process, which is particularly critical in terms of security, constitutes as usual the last method step.

The inventive production method is of course not limited to papers of value having sensitive optically variable elements. Other security elements such as safeguarding thread with micro- or negative prints can also be incorporated into papers of value in the described way. Since such security elements make lower demands on the paper material and treatment due to their high resistance in comparison to optically variable elements, they can be supplied at any desired points during papermaking. For example, they can be brought to the forming vat already after 85% paper accumulation so that the element is well protected, by being embedded in the remaining 15% that surrounds it at the end of papermaking, or only shortly before the final paper thickness exits.

Turning now to the drawings, FIG. 1 shows a lateral cross section of a paper of value 10 having an embedded security element, preferably an optically variable element 12. The optically variable element is embedded continuously in the paper material in the form of a strip, its surface being flush with the paper surface. The surface of the optically variable element, which preferably has a hologram structure 14, is visible over the entire surface from outside so that the optical effects are easy to check. This is not always the case with the known "window safeguarding threads" since the tiny surfaces that make the thread material visible are not very effective optically. The holograms may have a thickness, for example, of about 10 to about 50 micrometers.

Figure 2:
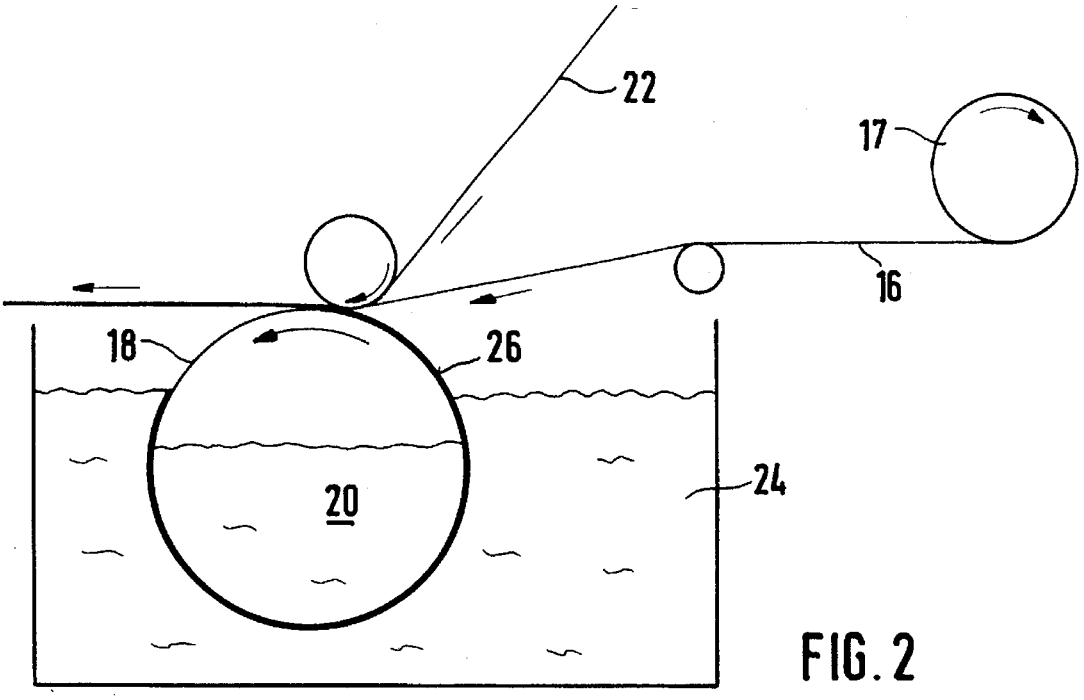
FIGS. 2 to 9 show schematic representations of a cylinder machine for application according to the present invention of the optically variable elements.

The optically variable element exists as a thin self-supporting film strip 16 but it is as well possible to arrange the optical variable layers in a carrier film consisting of paper, metal or any other suitable material. In the following the expression "carrier film" shall always include these versions as well. As indicated in FIG. 2, strip 16 is fed to the paper machine so as to lie on paper fiber layer 26 already formed. Strip 16 is thereby introduced between pick-up felt 22 and paper fiber layer 26 leaving forming vat 18. Film strip 16 is removed from a supply reel 17.

The paper layer is formed on forming vat 18 in the known way. Liquid is removed from pulp 24 through interior 20 of forming vat 18, whereby the paper fibers are deposited on the forming vat.

Figure 3:
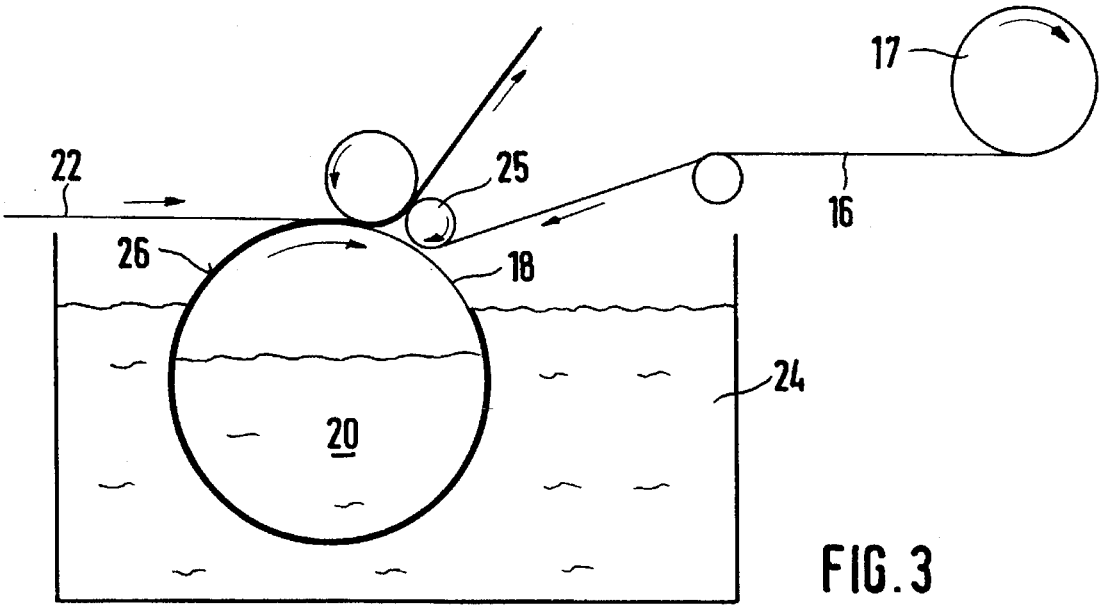

The introduction of carrier film 16 between felt 22 and paper layer 26 permits a particularly good guidance and precise placement of carrier film 16. However, as shown in FIG. 3, the carrier film with the optically variable elements can also be placed on the other side of paper layer 26, i.e. introduced for example in the gap between rollers 25 and paper layer 26.

Figure 4:
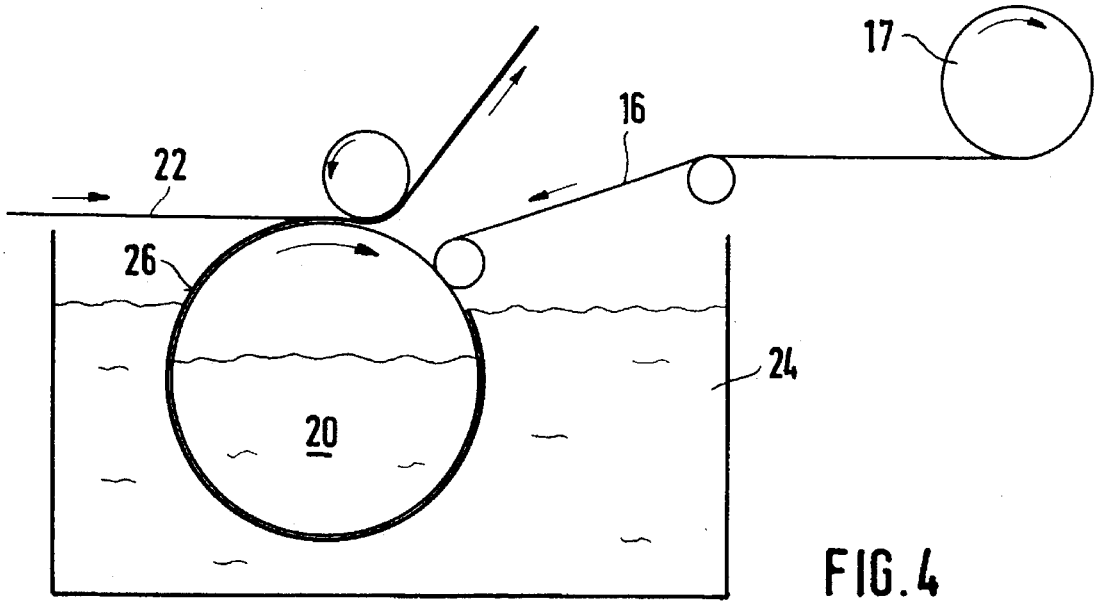

A further possible way of introducing the thread is shown in FIG. 4, in particular for narrow threads. In this case, film 16 carrying the optically variable element is already applied to the forming vat before papermaking. This possibility is particularly suitable for threads whose width is in the range of the paper fiber length or smaller, since no fibers are deposited on the thread itself but those which are deposited on the vat in the direct environment of the thread overlap the thread so that a paper base has nevertheless formed in this way in the area of the thread when the pulp is left.

In a preferred embodiment the side of film strip 16 facing the paper web is provided with an adhesive layer, thereby obtaining a stronger fixation of the film to the paper surface. The adhesive layer can be designed either as a water-soluble wet adhesive or as a hot-melt adhesive. When the paper web dries, the adhesive is activated and/or hardened. The element is thereby firmly anchored in the paper.

The feeding of the security element is described here for the sake of clarity, with reference to a machine having only one forming vat. However, it is routine to transfer this method to a machine having two-layer production. In this case, the thread is supplied to the vat that produces the major part of the paper thickness.

FIGS. 5 to 9 show various possibilities for bringing film strip 16 within pulp 24 on forming vat 18 after, e.g., 90% of the final paper thickness exists.

Figure 5:
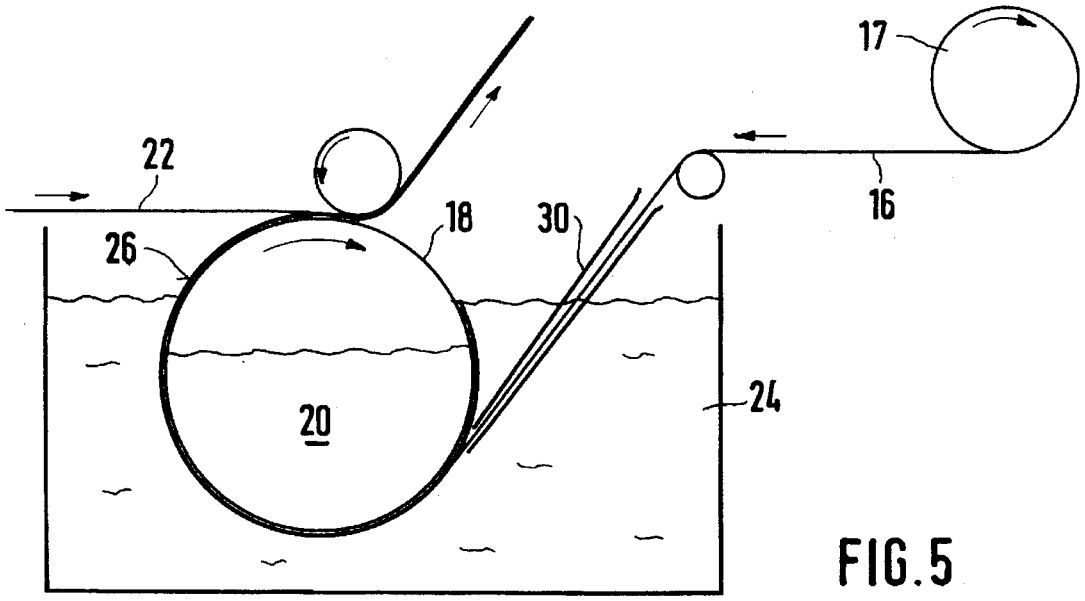

As is apparent from FIG. 5, hologram film 16 is thereby applied to paper 26 with a nozzle 30, like a customary safeguarding thread, nozzle 30 being submerged into pulp 24 to a distance sufficient to reach a place where sufficient paper is formed. In front of film 16, no paper is deposited if film 16 is wide enough or if the paper has substantially reached its final thickness, since the film prevents water permeability of the paper and vat in its contact area. In this method as well, hologram film 16 can be coated, e.g., with a hot-melt adhesive. In the hot dryer section of the paper machine, it is then firmly connected with the paper. A disadvantage is that the adhesive (e.g. hot-melt adhesive) may at first have only minimal adhesive strength upon application, since otherwise film 16 would stick in application nozzle 30. Film 16 is first held only with the "inherent adhesive strength" of moist paper 26, i.e. by adhesion. For wider, thicker and more rigid films, the methods described below are therefore more suitable.

Figure 6:
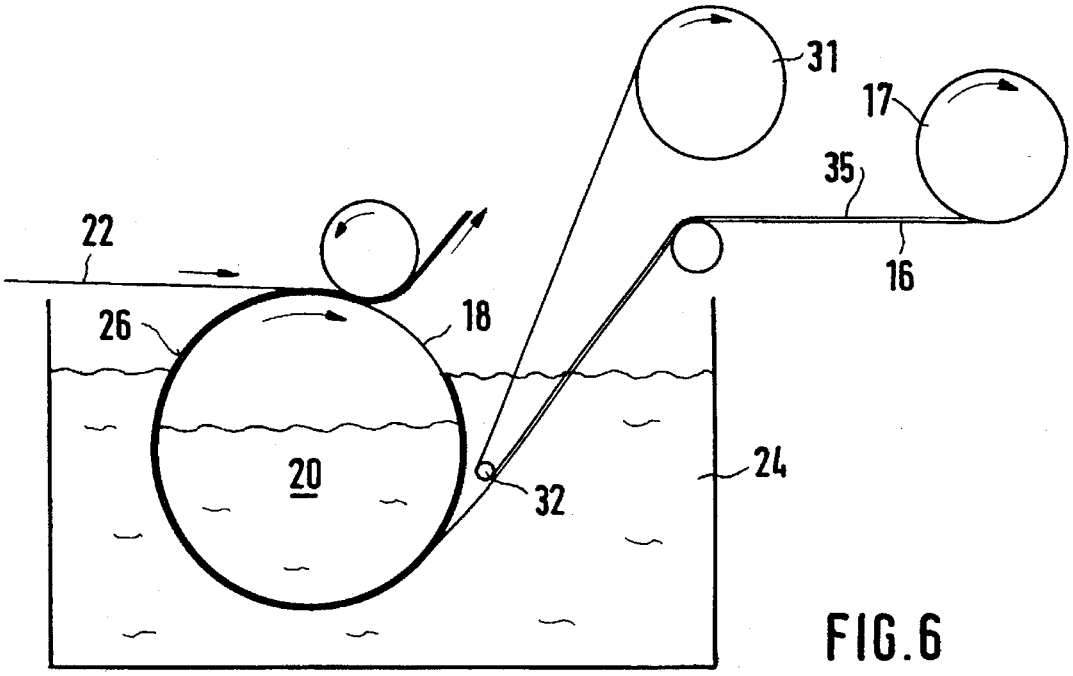

FIG. 6 shows a method which permits application of a hologram film 16 which is coated with a strong contact adhesive and provided with a silicone paper 35 protecting the coated side, as is customary in such cases. As is customary, this double film, comprising hologram carrier film 16 and silicone paper 35, is removed from a supply reel 17 and brought via deflection rollers to forming vat 18. At the same place there is located removing means 32 for silicone paper 35, which substantially comprises a deflection roller that feeds the removed silicone paper to a storage roller 31.

If weaker contact adhesives such as adhesive tape are used, it suffices to cover the side of film 16 coated with adhesive during the feed to forming vat 18, so that in this case only hologram film 16 is found on dispensing roller 17.

Figure 7:
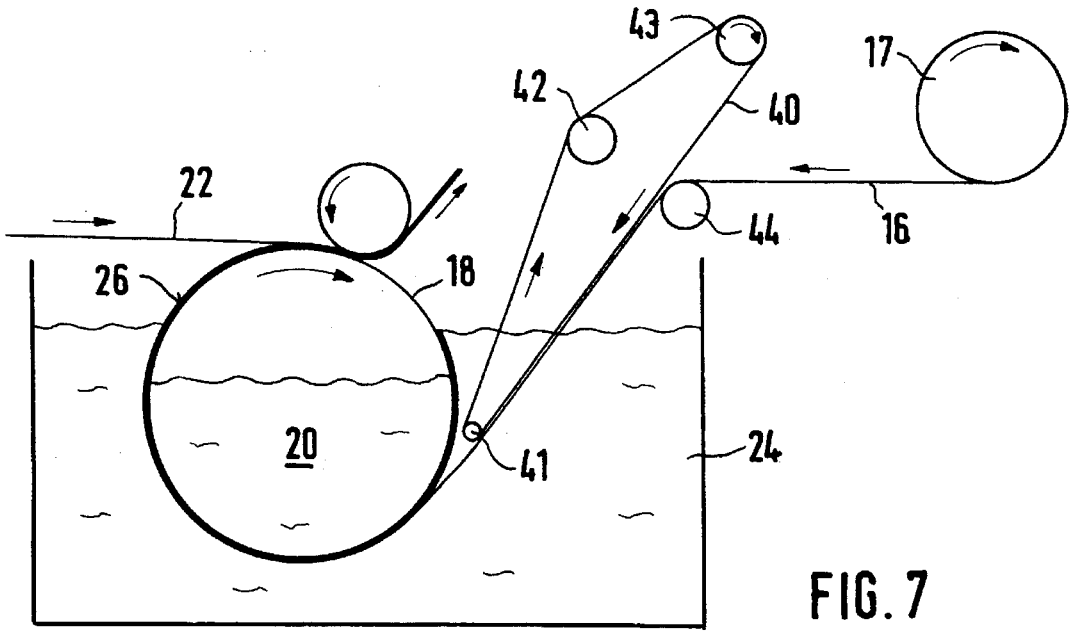

FIG. 7 shows such a method wherein a self-contained silicone-coated carrier band 40 is used as a protective cover. This band covers a path defined by deflection rollers 41 to 43, whereby it covers the adhesive upper surface of hologram film 16 in the area between deflection rollers 44 and 41. This prevents paper fibers or other substances contained in the pulp from being deposited on the adhesive coating and thereby impairing the adhesion to the wet sheet material.

Figure 8:
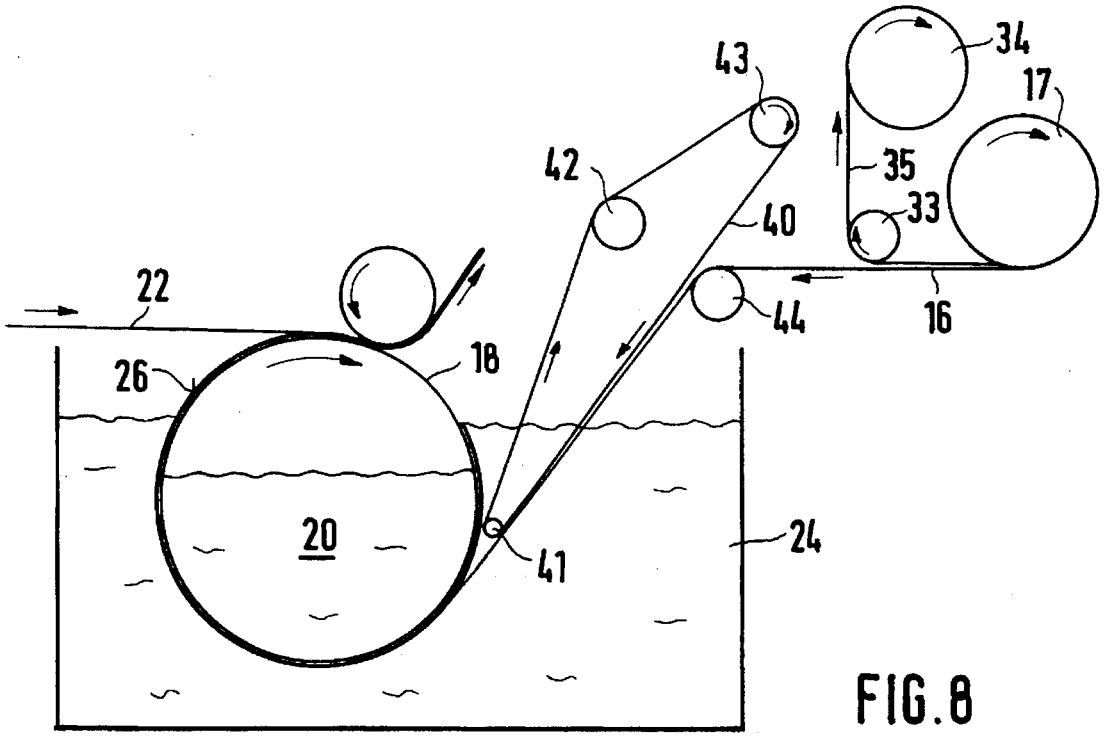

The methods shown in FIGS. 6 and 7 can be combined as shown in FIG. 8 to facilitate the winding up of a hologram film 16 coated with contact adhesive, by using silicone paper 35. Silicone paper 35 is removed from film 16 via deflection roller 33 directly after dispensing roller 17 and fed to a storage roller 34. The now exposed adhesive coating of film 16 is protected during further transport to the wet paper web by a travelling silicone-coated band 40, just as in the above-described method.

Figure 9:
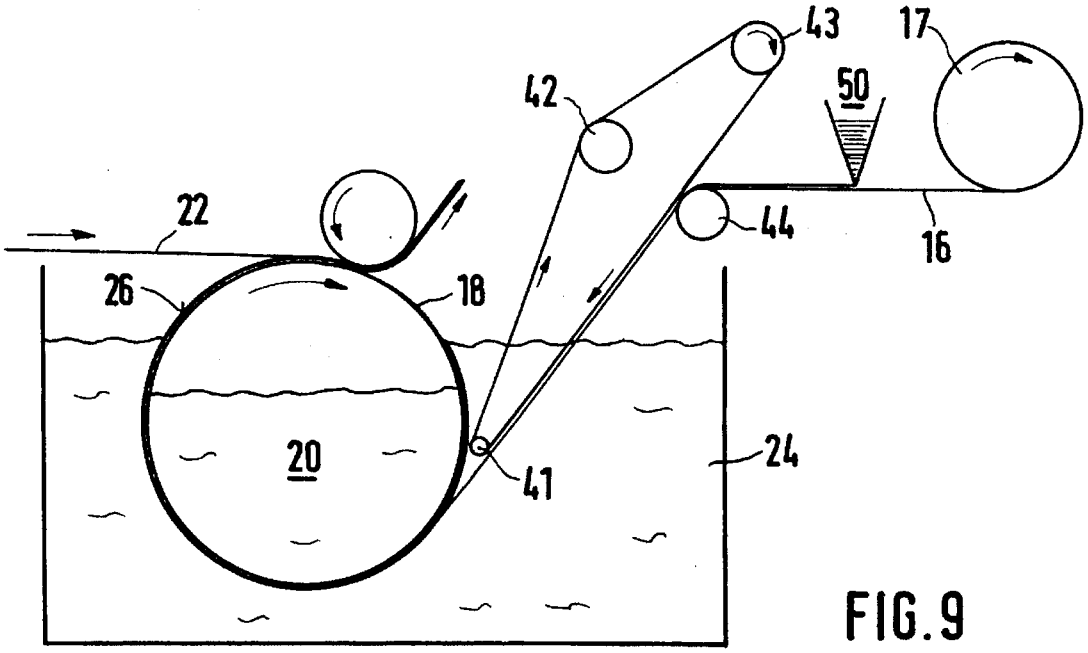

A further alternative to the methods described above for introducing hologram films coated with contact adhesive is provided by the procedure shown in FIG. 9. Hologram film 16 is in this case coated with adhesive 50 directly before being introduced into the paper machine and transported to the forming vat by the known method with the aid of a travelling silicone-coated band 40.

Suitable adhesives include not only heat-set and contact adhesives but also other adhesives such as multi-component adhesives or adhesives which are activated in water. It is also advantageous to use adhesive mixtures whereby the films are fastened provisionally first and then firmly connected with the paper in later production steps (e.g. during drying and calendering under the action of heat).

After the hologram film is applied to the paper layer, the latter runs in the usual way through the further treatment units of the paper machine. During calendering, the film is pressed into the soft paper layer in the way shown in FIG. 1, whereby the paper fibers adapt to the smooth surface of the element.

If an endless strip is not applied but rather individual elements, the transfer band must be removed again after the elements are anchored in the paper. This is preferably done after the paper web has been dried but in any case before the gluing unit. The same procedure is necessary if endless strips are to be applied by the transfer method or thin films with low inherent stability are to be fixed to the paper surface.

After the quality inspection, the paper web is ready for printing. It can either be wound up on a winding-up means and stored or directly introduced into a printing machine.

The inventive method is not limited to a cylinder machine. In an endless wire machine the hologram film can accordingly be supplied shortly before or after the paper fiber layer leaves the vat in the same way as was explained in connection with a cylinder machine.

The invention has been described with reference to certain preferred embodiments which are illustrative only. It is apparent that the invention also includes other embodiments that differ in immaterial respects from the embodiments described above, for example, as a result of modifications, additions and/or substitutions. It is intended that all embodiments of the invention be encompassed by the claims.

What is claimed is:

1. A method of producing a paper of value with an optical variable element, comprising:

(a) providing a transfer band carrying an optical variable element;

(b) feeding the transfer band to a wet paper web being formed on a paper making machine and embedding the transfer band on a surface of the wet paper web;

(c) calendering the paper web in the paper machine together with the transfer band lying on the surface of the paper web;

(d) bonding the optical variable element to the paper web with sufficient strength by drying and hardening the paper web to permit removal of the transfer band; and (e) removing the transfer band from the paper web.

2. The method of claim 1, wherein the transfer band is an endless transfer band such that the optical variable element of step (a) is disposed on the endless transfer band in the form of individual labels.

3. A method of claim 1, wherein the optical variable element is coated with an adhesive on a side facing the wet paper web, prior to embedding the transfer band on a surface of the wet paper bed.

4. A method of claim 1, wherein the feeding of step (b) comprises introducing the transfer band into a cylinder machine between a pick-up felt and the wet paper web running off a forming vat.

5. A method of claim 1, wherein the transfer band is supplied to the surface of the paper web facing away from the pick-up felt said supply being performed before calendering step (c).

6. A method of producing a paper of value with an optical variable element, comprising:

a) providing a transfer band carrying an optical variable element;

b) feeding the transfer band to a wet paper web being formed on a paper making machine, wherein the transfer band is coated with an adhesive on a side facing the wet paper web, and embedding the transfer band on a surface of the wet paper web;

c) bonding the optical variable element to the paper web with sufficient strength by calendering the paper web in the paper machine together with the transfer band lying on the surface on the paper web to permit removal of the transfer band;

d) removing the transfer band from the paper web; and e) drying and hardening the paper web together with the optical variable element.

7. A method of claim 6, wherein the optical variable element of step (a) is coated with an adhesive on a side facing the paper web.

8. A method of claim 7, wherein the optical variable element of step (a) is transported to the wet paper web with the aid of a circulating silicon coated carrier web which covers the side coated with said adhesive and which is removed directly before contacting the wet paper web.

9. A method of claim 7, wherein the optical variable element is provided for the feeding of step (b) on a dispensing roller and wherein the optical variable element of step (a) is provided with a protective silicon paper which is removed directly after the dispensing roller.

10. A method of claim 6, wherein the optical variable element of step (a) are disposed on an endless transfer band in the form of individual labels.

11. A method of claim 6, wherein the feeding of step (b) comprises introducing the transfer band into a cylinder machine between pick-up felt and the paper web running off a forming vat.

12. A method of claim 6, wherein the transfer band is supplied to the surface of the paper web facing away from the pick-up felt said supply being performed just before calendering step (c).

13. A method of claim 1, wherein in the resulting paper of value, the optically variable element is embedded in the surface of the paper such that it is flush with the surface of the paper.

14. A method of claim 6, wherein in the resulting paper of value, the optically variable element is embedded in the surface of the paper such that it is flush with the surface of the paper.

15. A method of producing a paper of value with an optical variable element comprising:

(a) providing the optical variable element as a thin self-supporting film strip;

(b) feeding the thin self-supporting film strip to a wet paper web being formed on a paper making machine, the feeding being performed with the aid of a circulating silicon coated carrier web with an adhesive being applied to the carrier web before it is brought into contact with the thin self-supporting film strip;

(c) releasing the thin supporting film strip from the circulating silicon coated carrier web and embedding the thin self supporting film strip on a surface of the wet paper web;

(d) calendering the wet paper web in the paper machine together with the thin self-supporting film strip lying on the surface of the paper web; and (e) bonding the thin self-supporting film strip to the paper by drying and hardening the paper.

16. A method of producing a paper of value with an optical variable element comprising:

(a) providing the optical variable element as a thin self-supporting film strip on a dispensing roller, the thin self-supporting film strip being coated with an adhesive forming an adhesive layer on a side facing the wet paper web and the adhesive layer is covered by a silicone paper, (b) feeding the thin self-supporting film strip to a wet paper web being formed on a paper making machine;

(c) removing the silicone paper directly before contacting the wet paper web and embedding the film strip on a surface of the wet paper web;

(d) calendering the paper web in the paper machine together with the thin self-supporting film strip lying on the surface of the paper web; and (e) bonding the thin self-supporting film strip to the paper by drying and hardening the paper.

17. A method of claim 15 or 16, wherein in the resulting paper of value, the optically variable element is embedded in the surface of the paper such that it is flush with the surface of the paper.

* * * * *